US007468123B2

(12) United States Patent
Heller et al.

(10) Patent No.: US 7,468,123 B2
(45) Date of Patent: Dec. 23, 2008

(54) METHOD FOR ELECTROLYTIC COATING OF MATERIALS WITH ALUMINUM, MAGNESIUM OR ALUMINUM AND MAGNESIUM ALLOYS

(75) Inventors: Jorg Heller, Engelskirchen (DE); Hans De Vries, NG Heerde (NL); Matthias Hartel, Cologne (DE)

(73) Assignee: Aluminal Oberflachentechnik GmbH & Co. KG, Montabaur-Heiligenroth (DE)

( * ) Notice: Subject to any disclaimer, the term of this patent is extended or adjusted under 35 U.S.C. 154(b) by 0 days.

(21) Appl. No.: 10/528,125

(22) PCT Filed: Jul. 15, 2003

(86) PCT No.: PCT/EP03/07632

§ 371 (c)(1),
(2), (4) Date: Nov. 21, 2005

(87) PCT Pub. No.: WO2004/033762

PCT Pub. Date: Apr. 22, 2004

(65) Prior Publication Data

US 2006/0137990 A1 Jun. 29, 2006

(30) Foreign Application Priority Data

Sep. 25, 2002 (EP) ..... 02021402

(51) Int. Cl.
*C25D 3/56* (2006.01)
*C25D 3/00* (2006.01)

(52) U.S. Cl. ..... 205/238; 205/261

(58) Field of Classification Search ..... 205/238, 205/261

See application file for complete search history.

(56) References Cited

U.S. PATENT DOCUMENTS 3,969,195 A * 7/1976 Dotzer et al. ..... 205/103
6,652,730 B1 * 11/2003 Lehmkuhl et al. ..... 205/236

FOREIGN PATENT DOCUMENTS

DE 1 212 213 B 3/1966
DE 21 22 610 A 11/1972
DE 198 55 666 A1 6/2000
DE 19855666 A1 * 6/2000

* cited by examiner

*Primary Examiner*—Edna Wong
(74) *Attorney, Agent, or Firm*—Knobbe Martens Olson & Bear LLP

(57) ABSTRACT

The invention concerns a method for electrolytic coating of materials with aluminum, magnesium or aluminum and magnesium alloys. The method is characterized in that the material is pretreated by being immersed in an electrolytic solution, where it is anodized, the electrolytic coating being performed immediately after in the same electrolytic solution.

18 Claims, No Drawings

METHOD FOR ELECTROLYTIC COATING OF MATERIALS WITH ALUMINUM, MAGNESIUM OR ALUMINUM AND MAGNESIUM ALLOYS

RELATED APPLICATIONS

This application is a U.S. National Phase under 35 U.S.C. 371 of the International Application PCT/EP2003/007632, filed Jul. 15, 2003, designating the United States and published in German on Apr. 22, 2004 as WO 2004/033762, which claims the benefit of European Patent Application No.: 02021402.9, filed Sep. 25, 2002.

FIELD OF THE INVENTION

The present invention relates to a method for electrolytic coating of materials with aluminum, magnesium or aluminum and magnesium alloys, in which method the material is immersed in an electrolyte for pretreatment, being connected as anode therein, and electrolytic coating is performed in the same electrolyte immediately thereafter. The method according to the invention improves the quality of the deposited aluminum, magnesium or aluminum/magnesium coatings.

BACKGROUND OF THE INVENTION

Deposition of aluminum, magnesium or aluminum/magnesium alloys on materials consisting of base metals is a convenient way of protecting such materials from corrosion. At the same time, they are provided with a decorative coating. To this end, the protective metal layer is predominantly deposited on the material by means of electroplating. Advantageously, the aluminum, magnesium or aluminum/magnesium layer is coated on the material with no coating of metallic intermediate layers between said metal layer and said material. If intermediate layers have been coated between the material and the surface layer of aluminum, magnesium or aluminum/magnesium alloy, there is a risk of contact corrosion due to the coated intermediate layer. In addition, thermal problems may arise due to the different expansion coefficients of the surface layer and intermediate layer.

Electrolytes found useful in the prior art include fused-salt electrolytes, such as electrolytes containing aluminum halides or aluminum alkyl complexes. A common feature in all of these electrolytic systems is that the material has to be cleaned prior to coating the surface thereof. Thus, particularly with materials consisting of base metals forming an oxide layer, there is a problem in that such oxide layers must be completely removed prior to coating. If the surface of such materials has not been completely cleaned, impurities or residues of the oxide layer of the metal constituting the material, which adhere to the surface, result in impaired adhesion of a metal layer subsequently coated by electrolysis. Furthermore, it is possible that no metal layer at all is coated on those spots where impurities are present on the surface, because said impurities normally are electrically non-conductive, thereby preventing electrolytic deposition at that spot. This inevitably gives rise to corrosion problems of the finished coated material at those spots where coating of the metal layer is incomplete.

DE-C3-22 60 191 describes a method of preparing materials made of electroconductive materials. In this method, the last process step, which serves to shape the materials, and in which a new bare surface is formed on the material, is performed in a suitable inert gas or inert fluid medium, with exclusion of atmospheric oxygen and moisture. This method turned out to be disadvantageous in that, particularly when using an inert fluid medium that covers the surface of the material and therefore might enter the coating electrolyte, the electrolyte is subsequently contaminated or hydrolyzed by same. When using inert gas media, one problem arising in large-scale industrial applications is that an inert gas atmosphere absolutely free of oxygen cannot be accomplished in practice. Traces of oxygen present in the inert gas atmosphere immediately oxidize the bare metal surface of the material, thus giving rise to the above-described loss in quality of the metal layer subsequently coated by means of electroplating. If, as described in DE-C3-22 60 191, the bare surface is achieved by means of a mechanical procedure, such as milling, cutting, sawing or drilling, or by means of massive deformation of the material using e.g. rolling or wire drawing, extrusion or other procedures, such procedures will give rise to an increased production tolerance of the finished material. As a result, materials produced according to the above method are not suitable for applications where highly constant quality and manufacturing are required.

DE-AS-12 12 213 describes the pretreatment of a material in a protective gas atmosphere. Alternatively, the oxide layer on the surface of the material can be removed by connecting the material as anode prior to deposition of the aluminum layer in the electrolyte which is produced from sodium fluoride and triethylaluminum. Thereafter, the current is reversed, and aluminum is deposited on the material. Disadvantageously, it has been found that the electrolyte can only be used in the deposition of aluminum on materials. Deposition of magnesium or aluminum/magnesium layers is not possible because the presence of halide ions in the electrolyte would result in immediate formation of insoluble magnesium halide compounds during anodic polarity, preventing deposition of magnesium or aluminum/magnesium on the material. The magnesium halides being formed would immediately stop the current in the electrolyte by blocking the electrodes.

DE-AS-21 22 610 describes a method for the anodic pretreatment of light metals for the electrodeposition of aluminum. Cleaning of the components is effected by treating the light metal materials in a fused electrolyte, thereby subjecting the materials to anodic load. The light metal materials cleaned in this way, being wetted with electrolyte, i.e. still loaded with fused electrolyte, are immersed in an aluminizing cell. During this operation, the possibility of oxygen still reaching the pretreated material, re-oxidizing it on the surface thereof, cannot be excluded. Furthermore, the aluminizing electrolyte is contaminated by the surface treatment electrolyte, which is a fused electrolyte. Only in those cases where the material consists of beryllium or aluminum, the fused electrolyte used in surface treatment by anodic oxidation of the material can also be used in the electrodeposition of aluminum on the beryllium or aluminum material. The fused electrolyte described in DE-AS-21 22 610 is only suitable for pretreatment of beryllium or aluminum materials in order to effect subsequent coating thereof with aluminum in the same fused electrolyte. The fused electrolyte is not suitable for electrodeposition of aluminum, magnesium or aluminum/magnesium layers on other materials.

DE-A1-198 55 666 describes an electrolyte suitable for the deposition of aluminum/magnesium alloy layers. The organoaluminum electrolyte disclosed therein contains $K[AlEt_4]$ or $Na[Et_3Al—H—AlEt_3]$, $Na[AlEt_4]$, as well as trialkylaluminum. The electrolyte can be present in the form of a toluene solution. Electrolytic deposition of aluminum/magnesium alloy layers from the electrolyte described therein is effected using a soluble aluminum anode and a likewise soluble magnesium anode, or using an anode made of aluminum/magnesium alloy. In the described method, the electrolyte composition is adjusted by pre-electrolysis in such a way that the deposited layer has the desired aluminum/magnesium ratio. Alternatively, $Mg[AlEt_4]_2$ can also be added to the electrolyte. Thus, the teaching of DE-A1-198 55 666 is that the ratio of aluminum and magnesium in the deposited aluminum/magnesium layer strongly depends on the concentration ratio of magnesium and aluminum in the electrolyte. As in all prior art methods, great care must be taken in the pretreatment of the materials to be coated, because impurities in the surface of the materials caused by oxidation or other influences result in reduced quality of the metal layer deposited by electroplating.

SUMMARY OF THE INVENTION

The technical object of the present invention is to provide a method, which method allows coating of aluminum, magnesium or aluminum/magnesium layers on materials, the quality of the metal coating being increased by an improved pretreatment of the material. More specifically, a method is to be provided wherein the materials to be coated are made free of adhering oxide layers or other impurities in a reliable and economic fashion, and wherein the intention is to prevent the materials from being recontaminated or reoxidized after pretreatment of the materials.

The technical object of the present invention is accomplished by means of a method for the electrolytic coating of materials with aluminum, magnesium, or alloys of aluminum and magnesium, in which method the material is immersed in an electrolyte for pretreatment, being connected as anode therein, and electrolytic coating is performed in the same electrolyte immediately thereafter, the electrolytic bath including organoaluminum compounds of general formula $M[(R^1)_3Al—(H—Al(R^2)_2)_n—R^3]$ (I) and $Al(R^4)_3$ (II) as electrolyte, wherein n is equal to 0 or 1, M is sodium or potassium, and $R^1$, $R^2$, $R^3$, $R^4$ can be the same or different, $R^1$, $R^2$, $R^3$, $R^4$ being a $C_1$-$C_4$ alkyl group, and a halogen-free, aprotic solvent being used as solvent for the electrolyte. The method according to the invention allows pretreatment of the material in that bath wherein electrolytic coating takes place later on. Surprisingly, impurities adhering to the non-pretreated material, as well as oxide layers present on the material, are removed. Surprisingly, the impurities thus introduced into the electrolytic bath do not impede the deposition of magnesium, aluminum or alloys of aluminum and magnesium on the material. Insoluble impurities can be removed continuously from the electrolytic bath, using suitable filtration systems.

Transfer of the materials from the pretreatment bath into the electrolytic bath after pretreatment is therefore no longer necessary. The above step, invariably involving the risk of re-contaminating the surface of the material, can thus be avoided.

In a preferred embodiment, an electrolyte in the form of a mixture of the complexes $K[AlEt_4]$, $Na[AlEt_4]$ and $AlEt_3$ is employed in the method according to the invention. The molar ratio of complexes to $AlEt_3$ is from 1:0.5 to 1:3, with a ratio of 1:2 being preferred.

In a preferred embodiment, 0 to 25 mole-%, preferably 5 to 20 mole-% $Na[AlEt_4]$ is employed, relative to the mixture of the complexes $K[AlEt_4]$ and $Na[AlEt_4]$.

In a preferred fashion, a mixture of 0.8 mol $K[AlEt_4]$, 0.2 mol $Na[AlEt_4]$, 2.0 mol $AlEt_3$ in 3.3 mol toluene can be used as electrolyte.

Alternatively, a mixture of $Na[Et_3Al—H—AlEt_3]$ and $Na[AlEt_4]$ and $AlEt_3$ can be used as electrolyte in the method according to the invention. The molar ratio of $Na[Et_3Al—H—AlEt_3]$ to $Na[AlEt_4]$ is preferably from 4:1 to 1:1, with a ratio of 2:1 being preferred. It is also preferred that the molar ratio of $Na[AlEt_4]$ to $AlEt_3$ is 1:2.

In another preferred embodiment, a mixture of 1 mol $Na[Et_3Al—H—AlEt_3]$, 0.5 mol $Na[AlEt_4]$ and 1 mol $AlEt_3$ in 3 mol toluene is used as electrolyte.

The electrolytic coating of materials with magnesium, aluminum or aluminum/magnesium alloys is preferably performed at a temperature of from 80 to 105° C. Preferred is an electroplating bath temperature of 91 to 100° C.

The electrolytic deposition of aluminum, magnesium or aluminum/magnesium layers on said materials is carried out using a soluble aluminum anode and a likewise soluble magnesium anode, or using an anode made of an aluminum/magnesium alloy. However, sole use of an aluminum or magnesium anode is also possible.

In the method of the invention, said anodic connection of the material for pretreatment can be maintained for a period of from 1 to 20 minutes, with 5 to 15 minutes being preferred.

The anodic load of the material required for pretreatment is effected using a current density of 0.2 to 2 $A/dm^2$, preferably 0.5 to 1.5 $A/dm^2$.

Any material suitable in electrodeposition can be used as material. In a preferred fashion, the material consists of a metal and/or metal alloy and/or is a metallized electrolyte-resistant material which can be dissolved in the electrolyte by means of anodic connection. The materials to be coated are preferably rack goods, bulk materials or continuous products such as wire, square-section sheet metal, screws or nuts.

The method according to the invention is remarkable in that impurities or oxide layers adhering to the materials are removed in a reliable fashion. Surprisingly, there is no adverse change in the electrolyte composition that would obstruct high-quality deposition of aluminum, magnesium or aluminum/magnesium layers on such materials. Furthermore, the electrodeposited metal layers are coated on the material in a firmly adhering and homogeneous fashion, because there is no recontamination of the material after cleaning. In addition to the advantages in quality specified above, cost-effectiveness in coating machined parts with metal layers is achieved by means of the above-mentioned process steps.

Without intending to be limiting, the inventive method for the electrolytic coating of materials with magnesium, aluminum or alloys of aluminum and magnesium will be illustrated with reference to the following examples.

DETAILED DESCRIPTION OF THE PREFERRED EMBODIMENT

EXAMPLES

Example 1

Phase a) A stamped part of an $AlMg_3$ alloy was first subjected to alkaline scouring for 2 minutes in a solution of 100 g/l NaOH at a temperature of 60° C. After washing in water the part was pickled in 10% nitric acid, subsequently washed in distilled water and dried.

Phase b) The dry part was introduced in a coating cell flooded with argon or nitrogen and, following prewashing in toluene, immediately introduced into the coating electrolyte. A mixture of the complexes $K[AlEt_4]$, $Na[AlEt_4]$ and $AlEt_3$ dissolved in toluene was used as electrolyte. A plate of AlMg25 alloy was used as counterelectrode. The product to be coated was first connected as anode and treated for 5 minutes at a current density of 1 $A/dm^2$ and an electrolyte temperature of 95° C. Subsequently, the polarity was reversed without removing the part from the electrolyte, followed by immediate coating for 45 minutes at a current density of 1.5 A/dm$^2$. A layer of AlMg alloy about 14 μm in thickness was deposited.

The adherence of the layer was checked using the cross-hatch adhesion test and heat shock test (1 hour at 220° C. and quenching in cold water). The deposited layer was found to have excellent adhesion on the base material. No detaching or blistering was detected.

Comparative Example 1

A part treated as comparative sample was treated and coated as in Example 1, but without previous anodic connection. In the cross-hatch adhesion test, it was possible to peel off the layer in the form of a foil. The layer exhibited blisters in the heat shock test.

Example 2

A magnesium AZ-91 alloy pressure-cast part was corundum-blast (granular size 0-50 μm) at 2 bars. Thereafter, the part was immediately introduced into the inert gas atmosphere of the coating cell, prewashed in toluene and immersed in the electrolytic bath as described in Example 1. The product to be coated was first connected as anode for 10 minutes at a current density of 1 A/dm$^2$. During this period, a layer of about 2 μm was removed from the product surface. Thereafter, the polarity was reversed, and the part was connected as cathode for 1 hour at 1.5 A/dm$^2$. An AlMg layer with a content of 23-25% Mg and a layer thickness of about 18 μm was deposited.

Subsequent adherence tests showed no layer detachment both in the cross-hatch adhesion test and heat shock test.

What is claimed is:

1. A method for electrolytic coating of a material with an aluminum, magnesium or alloys of aluminum and magnesium, said method comprising pre-treating an aluminum/magnesium alloy or zinc/magnesium alloy material by immersing in an electrolytic bath consisting of an electrolyte and a halogen-free, aprotic solvent, wherein said material is electrically connected as an anode therein, and anodically charging the material, and performing the electrolytic coating in the same electrolytic bath immediately thereafter by reversing polarity of the material, the electrolytic bath consisting of organoaluminum compounds of general formulas (I) and (II)

$$M[(R^1)_3Al—(H—Al(R^2)_2)_n—R^3] \quad (I)$$

$$Al(R^4)_3 \quad (II)$$

as the electrolyte, wherein n is equal to 0 or 1, M is sodium or potassium, and $R^1$, $R^2$, $R^3$, $R^4$ are the same or different $C_1$-$C_4$ alkyl groups, and the halogen-free, aprotic solvent being used as solvent for the electrolyte, wherein impurities introduced into the electrolytic bath during the pre-treating step do not impede the deposition of magnesium, aluminum or alloys of aluminum and magnesium on the material during the electrolytic coating step.

2. The method according to claim 1, wherein a mixture of the complexes $K[AlEt_4]$, $Na[AlEt_4]$ and $AlEt_3$ is employed as the electrolyte.

3. The method according to claim 2, wherein a molar ratio of said complexes $K[AlEt_4]$, $Na[AlEt_4]$ to $AlEt_3$ is from 1:0.5 to 1:3.

4. The method of claim 3, wherein the molar ratio of said complexes $K[AlEt_4]$, $Na[AlEt_4]$ to $AlEt_3$ is 1:2.

5. The method according to claim 2, wherein 0 to 25 mole-% $Na[AlEt_4]$ is employed, relative to the mixture of the complexes $K[AlEt_4]$ and $Na[AlEt_4]$.

6. The method according to claim 5 wherein 5 to 20 mole-% $Na[AlEt_4]$ is employed, relative to the mixture of the complexes $K[AlEt_4]$ and $Na[AlEt_4]$.

7. The method according to claim 2, wherein a mixture of 0.8 mol $K[AlEt_4]$, 0.2 mol $Na[AlEt_4]$, 2.0 mol $AlEt_3$ in 3.3 mol toluene is used as the electrolytic bath.

8. The method according to claim 1, wherein a mixture of $Na[Et_3Al—H—AlEt_3]$ and $Na[AlEt_4]$ and $AlEt_3$ is used as the electrolyte.

9. The method according to claim 8, wherein a molar ratio of $Na[Et_3Al—H—AlEt_3]$ to $Na[AlEt_4]$ is from 4:1 to 1:1.

10. The method according to claim 9, wherein a molar ratio of $Na[AlEt_4]$ to $AlEt_3$ is 1:2.

11. The method according to claim 10, wherein a mixture of 1 mol $Na[Et_3Al—H—AlEt_3]$, 0.5 mol $Na[AlEt_4]$ and 1 mol $AlEt_3$ in 3 mol toluene is used as the electrolytic bath.

12. The method of claim 9, wherein the molar ratio of $Na[Et_3Al—H—AlEt_3]$ to $Na[AlEt_4]$ is 2:1.

13. The method according to claim 1 wherein the electrolytic coating is performed at temperatures of from 80 to 105° C.

14. The method of claim 13, wherein the electrolytic coating is performed at temperatures of from 91 to 100° C.

15. The method according to claim 1 wherein the pre-treating step is performed for a period of from 1 to 20 minutes.

16. The method of claim 15, wherein the pre-treating step is performed for a period of from 5 to 15 minutes.

17. The method according to claim 1, wherein the pre-treating step is performed at an anodic load of the material with a current density of from 0.2 to 2 A/dm$^2$.

18. The method of claim 17, wherein the pre-treating step is performed at an anodic load of the material with a current density of from 0.5 to 1.5 A/dm$^2$.

* * * * *